United States Patent [19]

Förster et al.

[11] 4,109,710

[45] Aug. 29, 1978

[54] HEAT EXCHANGER

[75] Inventors: Siegfried Förster, Alsdorf; Manfred Kleemann, Quadrath, both of Fed. Rep. of Germany

[73] Assignee: Kernforschungsanlage Jülich Gesellschaft mit beschrankter Haftung, Jülich, Fed. Rep. of Germany

[21] Appl. No.: 731,672

[22] Filed: Oct. 12, 1976

Related U.S. Application Data

[63] Continuation of Ser. No. 572,759, Apr. 29, 1975, abandoned.

[30] Foreign Application Priority Data

Apr. 30, 1974 [DE] Fed. Rep. of Germany ..... 2420827

[51] Int. Cl.[2] ..... F28F 3/12

[52] U.S. Cl. ..... 165/165; 165/166

[58] Field of Search ..... 165/165, 166

[56] References Cited

U.S. PATENT DOCUMENTS 4,042,018 8/1977 Zebuhr ..... 165/166

*Primary Examiner*—Charles J. Myhre
*Assistant Examiner*—Theophil W. Streule, Jr.
*Attorney, Agent, or Firm*—Walter Becker

[57] ABSTRACT

A heat exchanger arrangement for the exchange of heat between fluid media in which the wall through which the heat is exchanged between the media is a pleated element which has a respective medium flowing along each side thereof, preferably in counterflow relation.

5 Claims, 5 Drawing Figures

HEAT EXCHANGER

This is a continuation of application Ser. No. 572,759 - Förster et al. filed Apr. 29, 1975, now abandoned.

The present invention relates to a heat exchanger for separately guided media, the heat exchanger matrix of which comprises a plurality of chambers arranged adjacent to each other and provided with inlet and discharge conduits for the media. The chambers are formed by folds of a band comprising a plurality of uniform folds, and by walls which are arranged alongside said folds at least partially overlapped by saddle sections of said folds.

The heat exchangers of the above mentioned type are provided for installations for converting energy by means of working media which are guided in a thermal circuit. These heat exchangers are preferably used for such installations in which a working gas is guided in a closed gas circuit, for instance, for high temperature reactors with helium turbine and for installations with closed working circuit for driving vehicles. With heat exchangers of this type, there exists the endeavor with a minimum of material relative to the structural volume of the heat exchanger to make available as large heat exchanger surfaces as possible for the heat transfer, by employing very thin materials.

A heat exchanger has become known, the heat exchanger matrices of which are composed of a plurality of chambers arranged adjacent to each other and made of folded sheet metal plates, are passed through by the heat exchanging media in countercurrent. One of the media is conveyed from the end face toward the heat exchanger matrix, whereas the other media flows through feeding lines overlapping the folds and arranged transverse to the saddles of the folds, into chambers having the end faces thereof closed. With these heat exchangers it is disadvantageous that for the required end face closure of a portion of the chambers it is necessary to weld together in pairs the respective fold edges which are adjacent to each other. For manufacturing reasons, a lower limit for the distance between the folds must be considered as minimum so that when employing the known building principle for heat exchangers as they are required, for instance, in connection with the heat exchange in high temperature reactors, voluminous devices are the result. Moreover, at high temperature differences between the media engaged in a heat exchange between the respective connecting areas of the conduits considerable problems occur due to the occurring heat tensions, which problems can only be mastered under difficulties.

It is, therefore, an object of the present invention to provide a heat exchanger for separately guided media with a low construction volume, in which occurring heat stresses cannot have a disadvantageous effect.

These and other objects and advantages of the invention will appear more clearly from the following specification, in connection with the accompanying drawings, in which.

Figure 1:
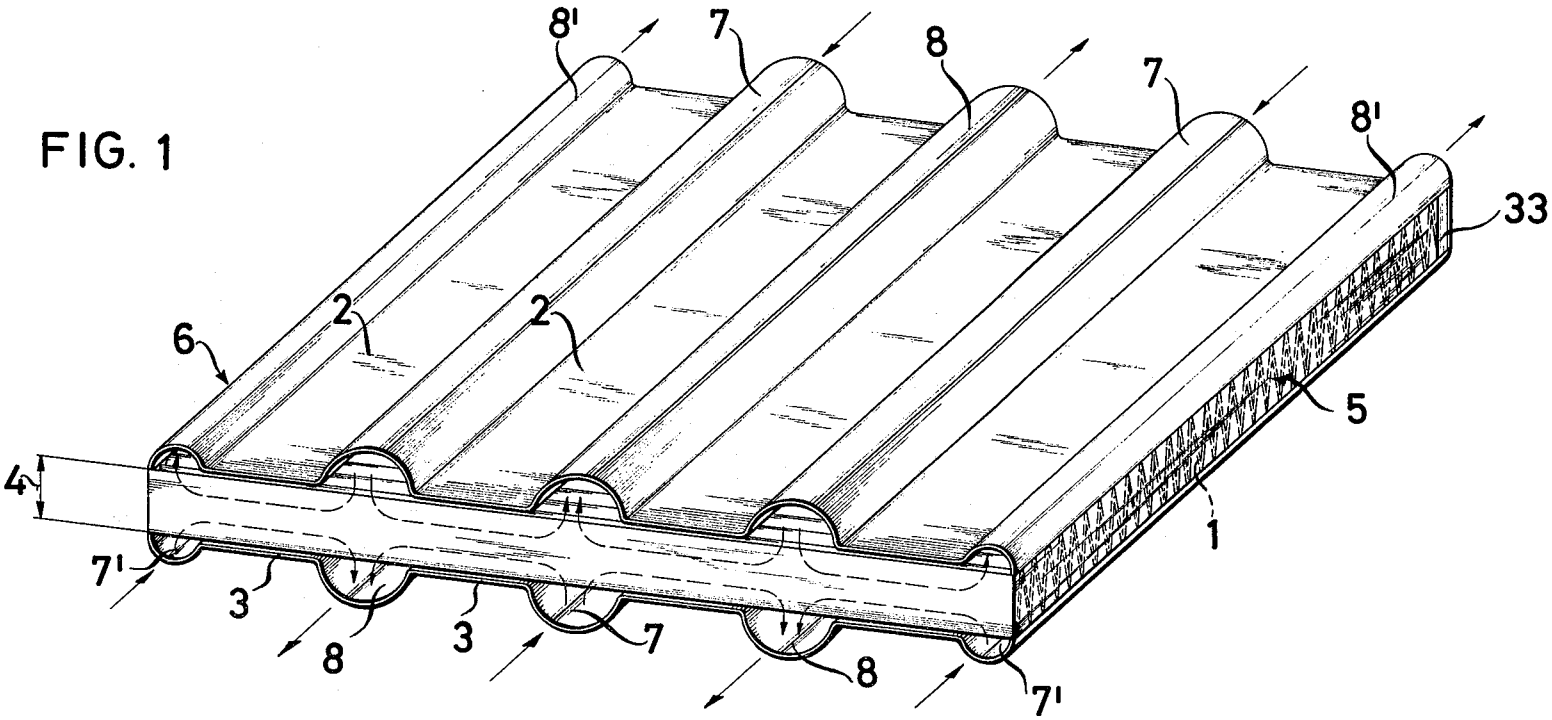
FIG. 1 illustrates a heat exchanger matrix with a plurality of feeding and discharging conduits for the media.

The heat exchanger according to the present invention intended for separately guided media and comprising a heat exchanger matrix having a plurality of adjacent chambers with feeding and dicharging conduits for the media while the chambers are formed from folds of a band and from folding saddles extending along said folds is characterized primarily in that at even distance from each other, a plurality of feeding and discharge conduits is provided for the media in alternating sequence parallel to completely closed end faces of the folds at both sides of the arrangement of folds while each feeding conduit for one of the media has associated therewith a discharge conduit for the other media.

Due to the complete closure of the end faces of the folds, it is possible with the heat exchanger according to the invention to select a shorter distance between the folds so that in an advantageous manner greater heat exchanger surfaces per volume unit of the heat exchanger matrix are obtained and the required heat exchanger volume is overall reduced. It is furthermore advantageous that the total conduit cross section required for the inlet and outlet of the media engaged in heat exchange is divided into a plurality of inlet and outlet conduits which are arranged adjacent to each other in alternating sequence. With this arrangement of the inlet and outlet conduits, it will be assured with the heat exchanger matrix will be passed through by a plurality of flows of media engaged in heat exchange. The flow of media which is fed into the chambers through feeding conduits is when entering the chambers divided into two media flows which pass through the chambers in opposite directions with regard to each other. The respective parts of the heat exchanger matrix which are located between the inlet and outlet conduits are passed through by the media in countercurrent. The arrangement of a plurality of inlet and outlet conduits on both sides of the train of folds will, with the exception of the end faces of the heat exchanger matrix, require no additional connections. In this way, a compensation of the heat stresses within the heat exchanger matrix is assured in an advantageous manner.

According to a further development of the invention, it is provided that the feeding and discharge conduits are formed by recesses in the walls overlapping the trains of folds. Due to this step, according to the invention, the heat exchanger matrix remains freely movable between its end faces to a major extent and independent of the design and association of the inlet and outlet conduits between the walls.

Referring now to the drawings in detail, the heat exchanger matrix of the heat exchanger comprises a plurality of chambers arranged adjacent to each other and formed by the folds of a band 1 having a train of uniform folds and by two walls 2, 3 arranged alongside said folds, said walls 2, 3 being overlapped by folding saddles formed by the folds.

The walls 2, 3 are spaced from each other by a distance which corresponds to the height 4 of the folds of said train of folds. The walls 2, 3 are, according to the embodiment of FIG. 1, connected to the folds of the band 1 along the end faces 5, 6 of the heat exchanger matrix. Along the longitudinal sides of the heat exchanger matrix there is arranged a closure strip 33. A particular seal between the fold saddles and the walls is not necessary because the same medium flows at both sides of the fold saddles.

Figure 2:
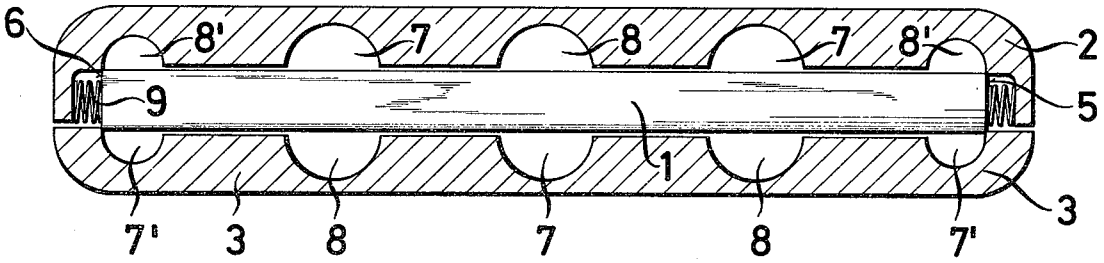
FIG. 2 shows a heat exchanger with feeding and discharging conduits formed by recesses or cutouts in the walls.

The end faces 5, 6 of the heat exchanger matrix are closed completely, which fact not only simplifies the manufacture of the heat exchanger matrix, but also makes it possible to select the distance between the folds very short so that large heat exchanger surfaces are available for the media passing through the heat exchanger matrix. Parallel to the end faces 5 and 6, the train of folds in the embodiment of FIGS. 1 and 2 are each overlapped by five feeding and discharge conduits which are arranged on both sides of the train of folds and at even distance from each other. The said feeding or inlet conduits are designated with the reference numeral 7, whereas the outlet conduits are designated with the reference numeral 8. On each side of the train of folds, the feeding and discharge conduits 7, 8 are arranged in alternating sequence while each feeding or inlet conduit 7 for one of the media has associated therewith a discharge conduit 8 for the other medium. The flow of the medium guided in one of the inlet conduits 7 divides when entering the chambers of the heat exchanger matrix into two media flows which flow through the chambers in opposite directions so that the heat exchanger is passed through by a plurality of flows of the media in heat exchange. According to the embodiment of FIG. 2, the inlet and discharge conduits 7, 8 which overlap the train of folds are formed by recesses in the walls 2, 3 so that the heat exchange matrix which is formed by the folds remains movable between its end faces 5, 6 relative to the walls 2, 3 independently of the association of the inlet and discharge conduits. At the end faces, expansion compensators 9 are provided.

Figure 3:
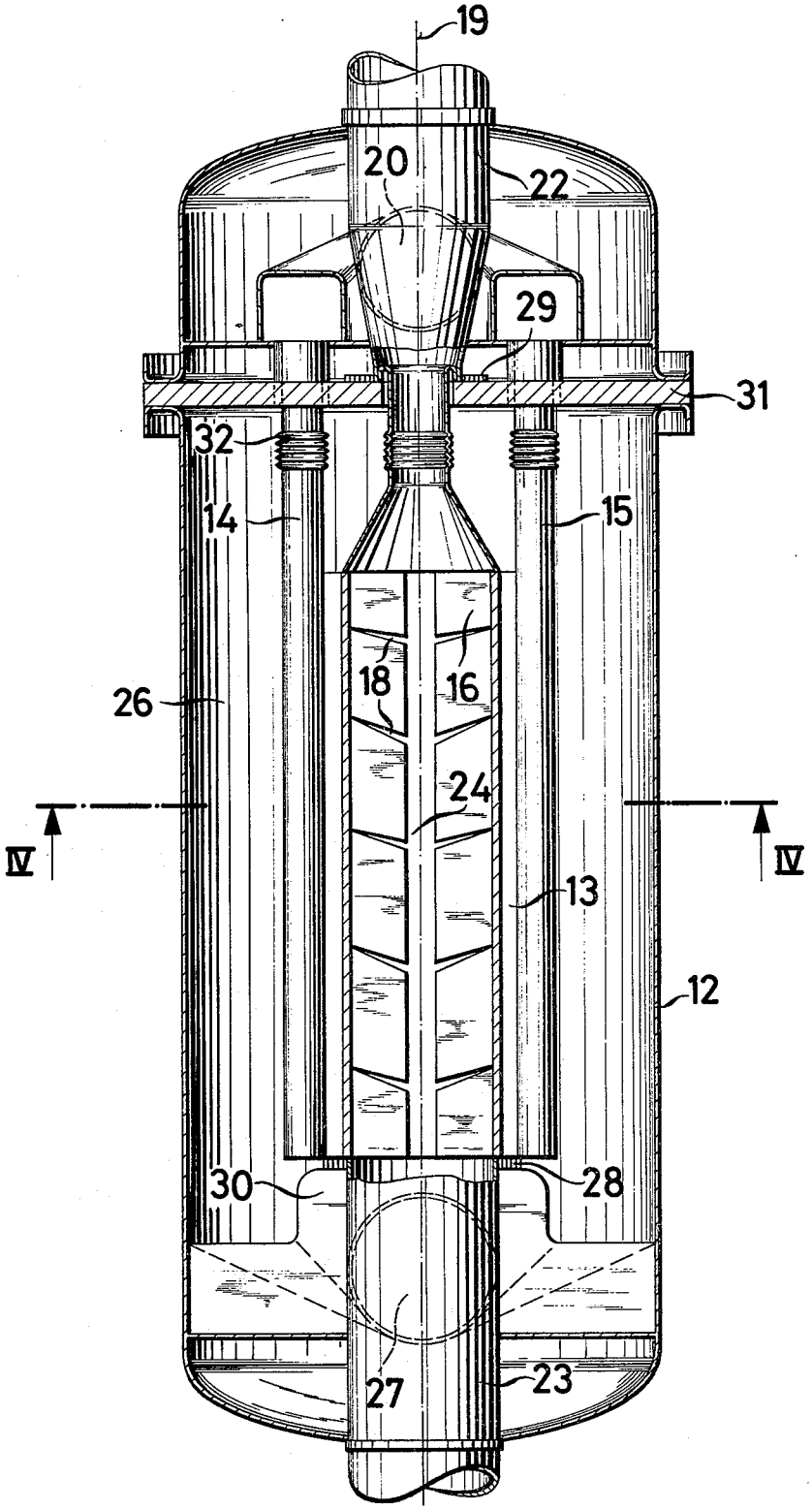
FIG. 3 represents a longitudinal section through a heat exchanger housing, said section being taken along the line III—III of FIG. 4.
Figure 4:
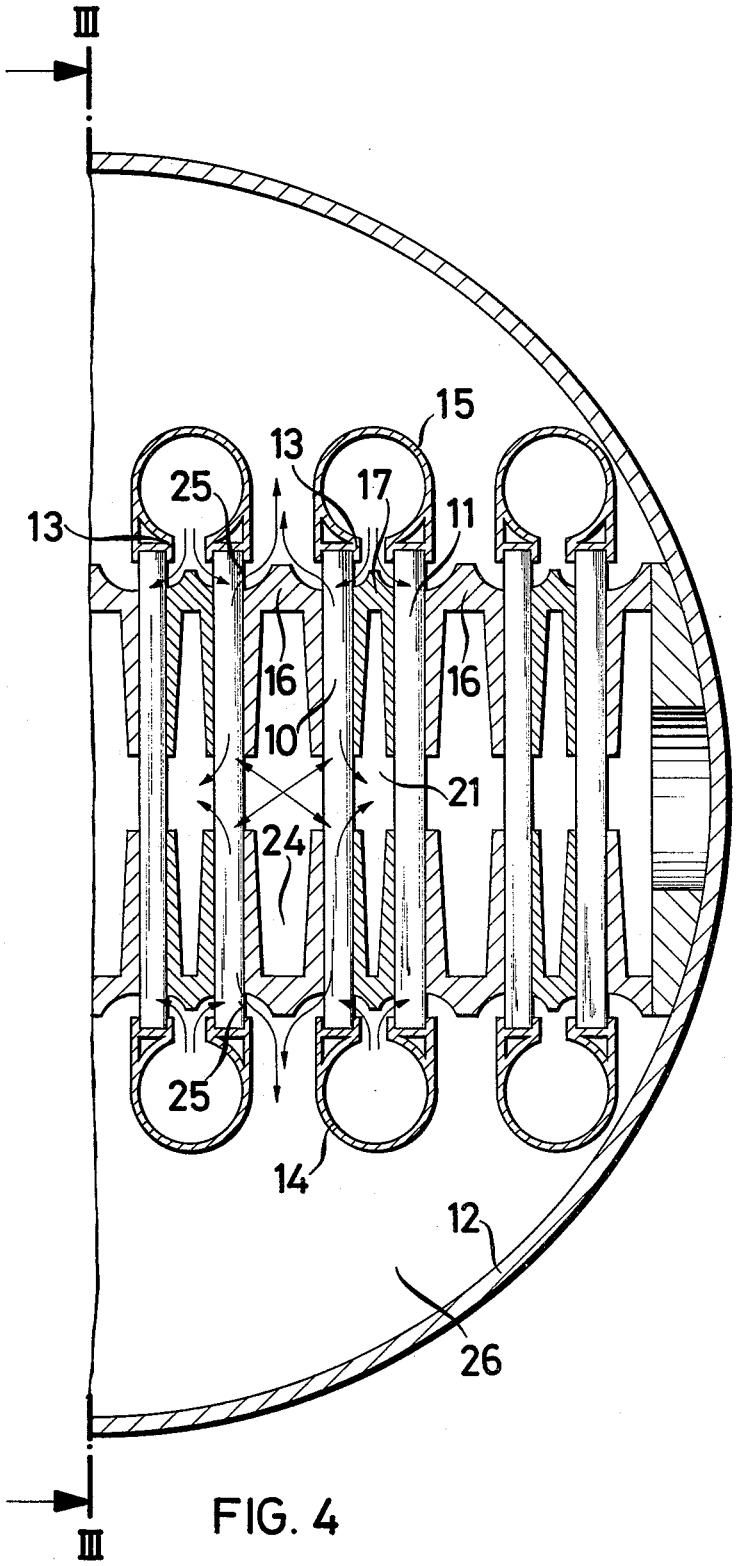
FIG. 4 is a cutout from a cross section of the heat exchanger housing according to FIG. 3, said cross section being taken along the line III—III of FIG. 4.
Figure 5:
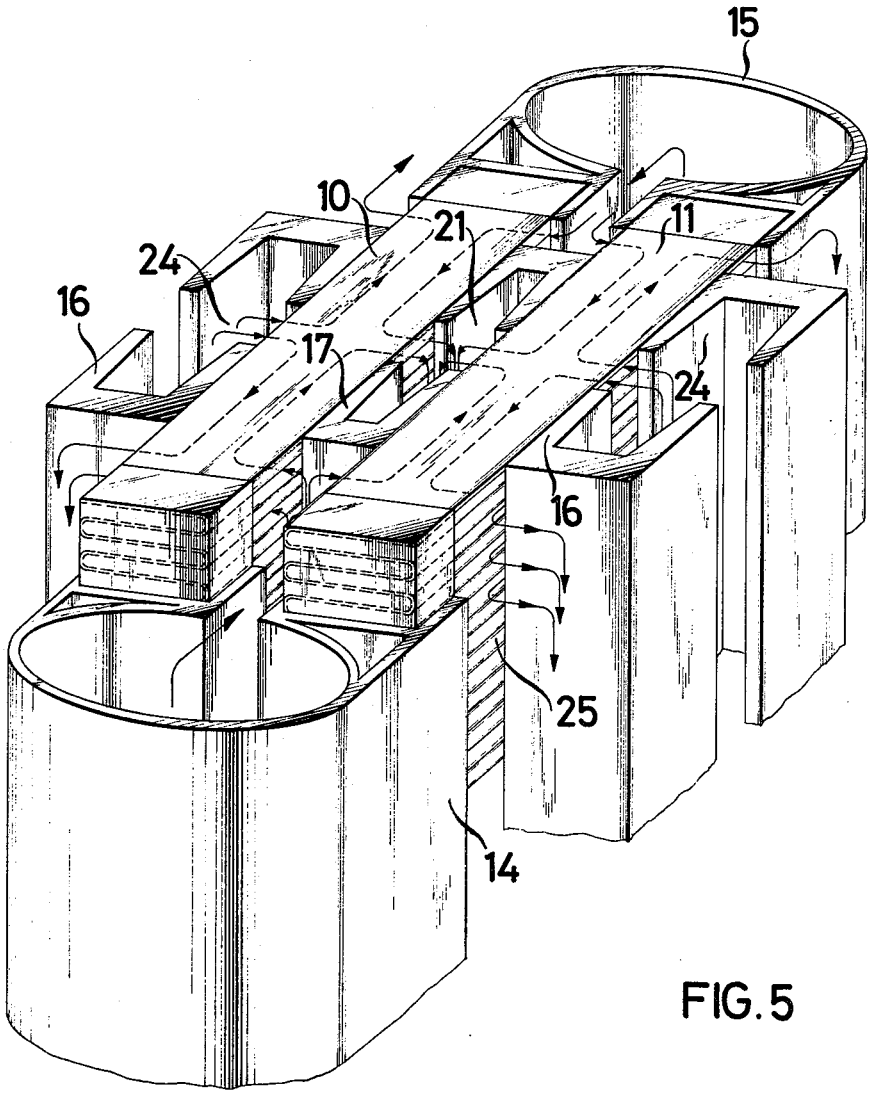
FIG. 5 represents a flow circuit for a heat exchanger unit inserted into the heat exchanger housing in conformity with FIG. 3.

The heat exchangers according to the invention are preferably employed in a heat exchanger device as it is illustrated in FIGS. 3–5. According to these figures, a further development of the invention consists in that a plurality of heat exchanger matrices 10, 11 are in parallel arrangement provided in a common housing 12. The inlet conduits or outlet conduits 7', 8' provided on the end faces 5, 6 of each two adjacent heat exchanger matrices 10, 11 forming an image to each other are at least for one of the media designed as collecting passage 14 or 15 which connects the heat exchanger matrices 10, 11 with each other to a heat exchanger unit 13. Between the heat exchanger units 13 there are provided heat exchanger units with supporting walls 16 which maintain a space between each other and are connected to the housing 12 while respectively forming walls 2, 3 of the heat exchanger matrices 10, 11. Inner covers 17 for the chambers are provided between the heat exchanger matrices 10, 11 which pertain to a heat exchanger unit and are arranged as an image to each other. Due to the arrangement according to the invention of the heat exchanger matrices 10, 11 within the housing 12, large heat exchanging surfaces of the entire heat exchanging device are made available for the heat exchange. A particular advantage of the heat exchanger according to the invention consists in that the heat exchanger units 13 are not in a fixed connection with the supporting walls 16 and therefore are in a simple manner insertable into the housing during the manufacture of the heat exchanger or in case of necessary repair of the heat exchanger matrices the heat exchanger units can easily be disassembled.

A further development of the heat exchanger according to the present invention is characterized in that the supporting walls 16 and the covers 17 have slot-shaped expansion gaps 18 which extend from the hot wall side to the region of the cooler wall side. Expediently, the expansion gaps 18, as illustrated in FIG. 3, are so designed that when the heat exchanger is not in operation, on that side of the supporting wall 16 and the cover 17 on which in condition of operation the hot media flow in or off, have a greater opening width relative to the remaining wall regions. In condition of operation of the heat exchanger, the expansion gaps 18 close to a major extent due to the heat expansion of the walls.

The heat exchanger units 13 are arranged in parallel within the housing 12. The collecting passages 14, 15 extend coaxially with regard to the longitudinal axis 19 of the housing 12. The medium which is under high pressure HD is, through a connecting line 20, provided on housing 12, fed to the collecting passages 14, 15. The outlet conduits 21 for the medium under high pressure are formed by recesses in the covers 17. The discharge conduits 21 lead into a housing chamber which comprises an outlet 22 for the medium heated in the heat exchanger. The medium which is under a low pressure ND flows into the heat exchanger through the inlet 23. The inlet lines 24 to the chambers of the heat exchanger units 13 for the medium under low pressure are formed by recesses in the supporting walls 16. As illustrated in FIG. 5, the medium cooled in the heat exchanger passes from the chambers through lateral openings 25 of the chambers into a free intermediate chamber 26 which is provided between the heat exchanger units 13 and the wall of the housing 12. From the chamber 26, the medium under low pressure flows through the discharge 27 on the heat exchanger housing 12 out of the heat exchangers. Due to the above steps and arrangements, it will be assured with the heat exchange according to the invention that the lateral walls of the housing 12 are located within the region of the wall flows of the medium and are kept at low constant temperature.

The seal of the chambers of the heat exchanger units 13 relative to the supporting walls 16 is realized by the fact that the fold saddles will, due to the medium under high pressure, rest against the supporting walls 16. A seal of the chambers relative to the covers 17 is realized by a preload of the covers 17 relative to the folds of the heat exchanger matrix. For purposes of sealing the chambers of the heat exchanger in which the introduced media flow, relative to the chambers in which the media to be discharged flow, labyrinth seals 28, 29 are provided expediently in the low pressure region as well as in the high pressure region. The labyrinth seal 28 in the low pressure region is provided between heat exchanger units 13 and the housing bottom 30 at the end face, whereas the labyrinth seal 29 is provided in the high pressure region between a cover plate 31 of housing 12 and the walls of the outlet 22. In this way, it will be assured that the heat exchanger units 13 can easily be removed. The collecting passages 14, 15 are passed in a gas-tight manner through the cover plate 31. In the vicinity of the passages for the collecting conduits 14, 15, expansion compensators 32 are provided for compensating for the expansions due to temperature changes.

A non-illustrated modification according to the heat exchanger of the invention consists in that the parallelly arranged heat exchanger units are distributed in a diamond fashion in a cylindrical housing around the housing axis, while the inlet conduits for the medium under low pressure and the outlet conduits for the medium under high pressure extend in a circular cross-sectional region coaxially with regard to the housing axis.

It is, of course, to be understood that the present invention is, by no means, limited to the specific showing in the drawings, but also comprises any modifications within the scope of the appended claims.

What is claimed is:

1. A double channel counter flow heat exchanger means having an independently removable matrix construction with cold free sides and a hot middle range subjected to high temperature differences at up to 450 psi; that normally would lead to undesired deformation for effecting heat exchange between first and second fluid mediums comprising in combination spaced walls forming said spaced sides, chamber-forming means including pleated means between said walls with the folds of said pleated means extending between and secured to said walls to form a chamber between each side of said pleated member and the adjacent wall, closure means between the sides of said walls to close the sides of said chamber, closure means connected to the ends of the pleated means to close the ends of said folds and the ends of said chambers between the ends of said walls, a plurality of channel means in each of said walls extending between the ends of said walls and across said folds and opening into the chamber formed by said folds, said channel means in each wall having inlets and outlets for a fluid medium at one end of the wall, so that one medium may flow through inlet channel means and between the folds to outlet channel means in each chamber to emerge from the same end of said wall, the inlets and outlets of each wall being at the end opposite the inlets and outlets of the other wall collectively in a mirror image as to guidance of fluid medium flow therewith.

2. A double channel counter flow heat exchanger means comprising in combination at least two heat exchangers separately removable as units without requiring disassembly of the other, each of said heat exchangers comprising a pleated element forming a wall between two chambers, the ends of the folds being closed, a housing in which said heat exchangers are mounted in common and are connected rigidly in parallel for a mirror image as to guidance of fluid mediums therewith, heat exchanger matrices defining headers originally connected adjacent to the ends of said heat exchangers forming inlet conduits therewith for one medium, first outlet conduit means for said one medium communicating with the heat exchangers rigidly connected therewith intermediate said headers, inlet conduits for the second medium communicating with said heat exchangers rigidly connected therewith in the range of said first outlet conduit means and on the opposite side of the respective pleated elements, outlet conduits for the second medium rigidly connected therewith leading from the ends of said heat exchangers into said housing from the said opposite side of said elements, coverings for the heat exchanger matrices located between the heat exchanger matrices connected with one heat exchanger and between adjoining heat exchangers, said coverings being rigidly connected with said housing and support walls formed therewith supporting said parallel connected heat exchangers in spaced relation in said housing and engaging the inside of the housing.

3. A double channel counter flow heat exchanger means in combination according to claim 2 in which said heat exchanger means comprises a housing in which said heat exchangers are mounted in common and are connected rigidly in parallel, heat exchanger matrices in parallel defining headers originally connected adjacent to the ends of said heat exchangers forming inlet conduits therewith for one medium, first outlet conduit means for said one medium communicating with the heat exchangers rigidly connected therewith intermediate said headers, inlet conduits for the second medium communicating with said heat exchangers rigidly connected therewith in the range of said first outlet conduit means and on the opposite side of the respective pleated elements, outlet conduits for the second medium leading rigidly connected therewith from the ends of said heat exchangers into said housing from the said opposite side of said elements, self-sealing labyrinth seal means located between the housing chamber-forming means and the inlet conduit means and outlet conduit means of said heat exchanger matrices, coverings for the heat exchanger matrices located between the heat exchanger matrices connected with one heat exchanger and between adjoining heat exchangers, said coverings being rigidly connected with said housing and support walls formed therewith supporting said parallel connected heat exchangers in spaced relation in said housing and engaging the inside of the housing.

4. A double channel heat exchanger means in combination according to claim 2 in which at least said support walls include means forming slot-shaped gaps to compensate for heat differential.

5. A double channel heat exchanger means in combination according to claim 3 which includes conduits for the respective media leading into said housing, and said labyrinth seal means surrounding said conduits and sealing around the conduits near the ends of said heat exchangers.

* * * * *